United States Patent [19]

Brasca

[11] 4,070,010

[45] Jan. 24, 1978

[54] VICE FOR A MACHINE TOOL BED

[76] Inventor: Carlo Brasca, Via Puccini, 13, Locate Triulzi (Milan), Italy

[21] Appl. No.: 748,808

[22] Filed: Dec. 8, 1976

[30] Foreign Application Priority Data

Dec. 19, 1975 Italy ..... 30603/75

[51] Int. Cl.[2] ..... B25B 1/18

[52] U.S. Cl. ..... 269/27; 269/247

[58] Field of Search ..... 269/20, 27, 28, 240, 269/243, 296, 247

[56] References Cited

U.S. PATENT DOCUMENTS

| | | | |
|---|---|---|---|
| 3,312,461 | 4/1967 | Copron | 269/246 |
| 3,603,579 | 9/1971 | Odom | 269/28 |

*Primary Examiner*—Robert C. Watson

*Attorney, Agent, or Firm*—Guido Modiano; Albert Josif

[57] ABSTRACT

A vice particularly suitable for mounting on a machine tool bed is described. The vice comprises a fixed jaw with a base and two guides thereon, a mobile jaw, a mobile carriage with guide gibs on the two guides, a motion transmission for prepositioning the mobile jaw, and a force transmission assembly for tightening the jaws. The mobile jaw is rigid with the carriage and a prepositionable support of the force transmission assembly may be halted at any point of its stroke and is slidably mounted by shoe means between the guides. Moreover the force transmission assembly of which the support forms part is in pushing engagement with the front wall of the carriage which carries the jaw.

2 Claims, 3 Drawing Figures

VICE FOR A MACHINE TOOL BED

BACKGROUND OF THE INVENTION

This invention relates to a vice, particularly suitable for mounting on a machine tool bed.

Vices for holding workpieces during their mechanical machining represent a basic tool which is among the most ancient and common of a workshop, and which has undergone continuous change and development to adapt it to the increasingly strict requirements of technology. These strict requirements are evident typically for example in milling, where very high powers are attained by the use of hard metal (widia) milling tools which enable deeper and faster passes to be made, and because of the strengthening of milling machines, so much so that the weak point in the machining process, namely that which limits the machining speed, is precisely the means for holding the workpieces being machined. The requirements of a vice in such powerful machining are that it must not allow the stressed workpiece to move, must not cause it to vibrate and must not vibrate with it, and must allow the workpiece to be rapidly gripped and released.

Traditional mechanical screw vices, even of improved type, cannot apply, by manual lever operation, more than 2000 kg of closure force and this can be raised to 4000 to 5000 kg by hammer blows, with consequent tool damage and loss of time. A simple and efficient method of increasing the clamping force and satisfying the larger common requirements, which are tending towards 20,000 kg is the introduction of the known principle of the hydraulic press with manual operation, this latter being an advantage as an operator must in all cases be present. This is applied in the following manner: using the usual handle, a mobile vice block is moved forward by means of a screw or generally by motion transmission means. When the block is halted by the workpiece, the handle continues to rotate to screw-feed a piston floating in a hydraulic sump, said piston pushing a secondary larger piston rigid with the mobile jaw, so passing to a second stage which may be called "force transmission." This force multiplication, of the order of ten times, requires a like multiplication in the stroke of the piston thrust by the handle, and thus a greater time. The biggest disadvantage of this method however is its relative mechanical complication, which has already been described. In order to speed up the movement and lighten the work of the operator, hydraulic operation of the vice has been conceived.

This method satisfies all the requirements of proper continuous clamping, but presents other constructional and operational disadvantages. As workpieces of very different sizes have to be clamped, the dynamic piston must have a considerable stroke, and a rod which projects by at least the same length. This fact leads to stability problems which are solved by very costly constructions. Moreover, the long idle movements are too slow. It was then decided to combine the mechanical worm device with the hydraulic device, to obtain the advantages of the two types and avoid the disadvantages peculiar to one or the other, particularly, the jaw setting movements are of the screw type, while the workpiece is clamped under pressure between the jaws hydraulically. This combination, which is today the most widespread of high power vices, has been effected in various ways. According to the example of the vice with the hydraulic press, from which when in position the actual mobile jaw projects.

This system requires two extra guides to move the jaw relative to the carriage. To avoid these supplementary guides, which are in themselves delicate members, a second type uses the same guides for the jaw and for the carriage with drived worm, but because of space requirements the jaw slide, in the form of a second carriage, has to be made too short and therefore insufficiently guided for the requirements of its operation and the stresses to which it is subjected. In a third type, the difficulty has been overcome by making both jaws mobile, one for large movements and screw operated, and one for small clamping movements operated hydraulically. But although this method overcomes the space problem, it aggravates the cost problem as it removes the advantage of the fixed jaw. It is easily apparent that holding a jaw on guides requires gibs of much larger dimensions and precision than holding a simple positioning and thrust bearing carriage, which does not require precision.

In a fourth type, the strokes of the screw and piston are reduced by arranging, on the bed comprising the guides, holes for example at three equal distances apart to enable the carriage, with the jaw projecting therefrom or forming an extension of it, to be moved manually and fixed by keys to the bed.

A fifth type of combined operation vice of the known art is different from the previous ones in that it lacks screw operation, which is replaced, only for the purpose of halting the carriage, by a fixed sawtooth toothing on the guide surface and an opposing mobile sawtooth toothing engaging therewith, on the carriage. The carriage is here positioned by hand by articulatedly raising the carriage, or at least the toothing associated therewith, and then engaging the two toothings in the required position. As the teeth of these latter are opposed, they prevent withdrawal of the jaws, and the carriage remains fixed and allows the relative jaw to emerge by hydraulic action for clamping purposes. The disadvantages of this original method are the manual movement and the discontinuous positioning of the carriage with the jaw, governed by the pitch of the teeth.

The five listed types represent substantially all the methods proposed by the known art.

SUMMARY OF THE INVENTION

The general object of the present invention is to eliminate or substantially reduce the remaining imperfections and disadvantages of the art of fixing by vice workpieces to be mechanically machined.

A particular object of the invention is to provide a vice of the combined movement type, namely a positioning movement and a clamping movement, which eliminates or reduces all the listed and other disadvantages of previous vices, without introducing others.

A further particular object of the invention is a vice of the specified type, all members of which are more rationally adapted to each other and to the function which each must perform, so avoiding superfluous members.

These and further objects which will be more evident hereinafter have been attained in practice by a vice for machine tool beds of the type comprising a fixed jaw with a base and two guides thereon, a mobile jaw, a mobile carriage, guide gibs on the two guides, a motion transmission for prepositioning the mobile jaw, and a force transmission assembly for tightening the jaws, characterized in that said mobile jaw is rigid with the carriage, and a prepositionable support of the force transmission assembly may be halted at any point of its stroke and is slidably mounted by its own shoe means between said guides, the shoe means of said support being interposed between the carriage gibs, said support being positioned inside the carriage, while the force transmission assembly of which the support forms part is in pushing engagement with the front wall of the carriage which carries the jaw.

BRIEF DESCRIPTION OF THE DRAWINGS

The characteristics, mode of operation and the advantages of the invention will be more evident from the detailed description of a preferred but not exclusive embodiment, given by way of example with reference to the accompanying drawing, in which.

DESCRIPTION OF THE PREFERRED EMBODIMENTS

Before passing to the analytical description of the invention, it would be useful to explain in an elementary manner its concept, which is plainly structural but has important functional implications.

Vices of this type all generally comprise a motion transmission and a force transmission, which have a common "prepositionable support" which is positioned by the former transmission and acts as a point of support for the latter transmission. The invention is not concerned with the type of the two transmissions, i.e. whether these are hydrodynamic, screw type, lever type etc., but instead consists of making the movable jaw rigid with a main carriage on the guides of the fixed jaw base, and making the support positionable inside said carriage, and guided by the same guides, with its own shoes inserted between the shoes or gibs of the carriage, i.e. mounted on the guides by being inserted into an intermediate gap in the carriage shoes. In this manner, the positionable support, which does not need accurate guiding, is given sufficient mechanical support on the guides without lengthening the guides, and the directional accuracy of the jaw-carriage is not prejudiced as the resisting moment of its shoes remains unchanged, because of the fact that the central missing part of the shoes does not in practice contribute to the guiding moment.

Even though precise transmission means are illustrated for this in the representation, these are not binding, and other means could be used without altering the spirit of the invention.

Figure 1:
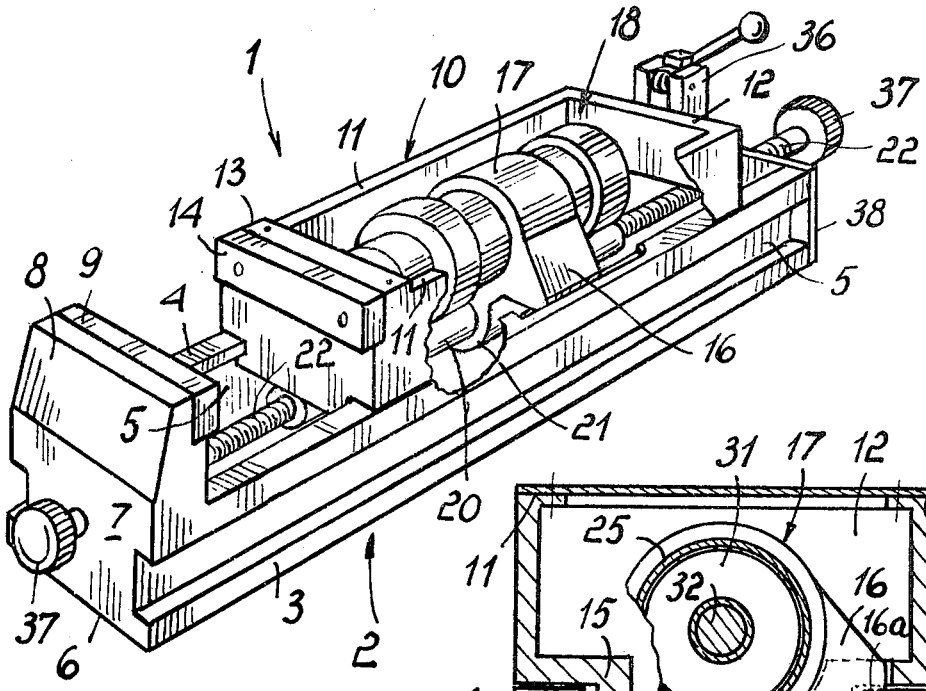
FIG. 1 is a perspective view of a vice according to the invention.
Figure 3:
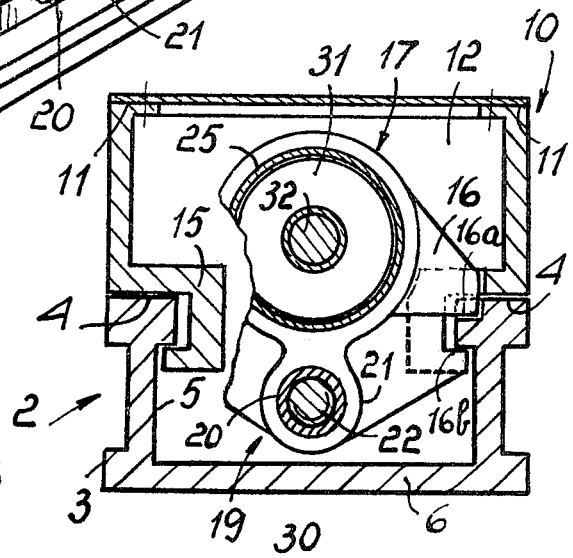
FIG. 3 is a cross-section through the same vice.
Figure 2:
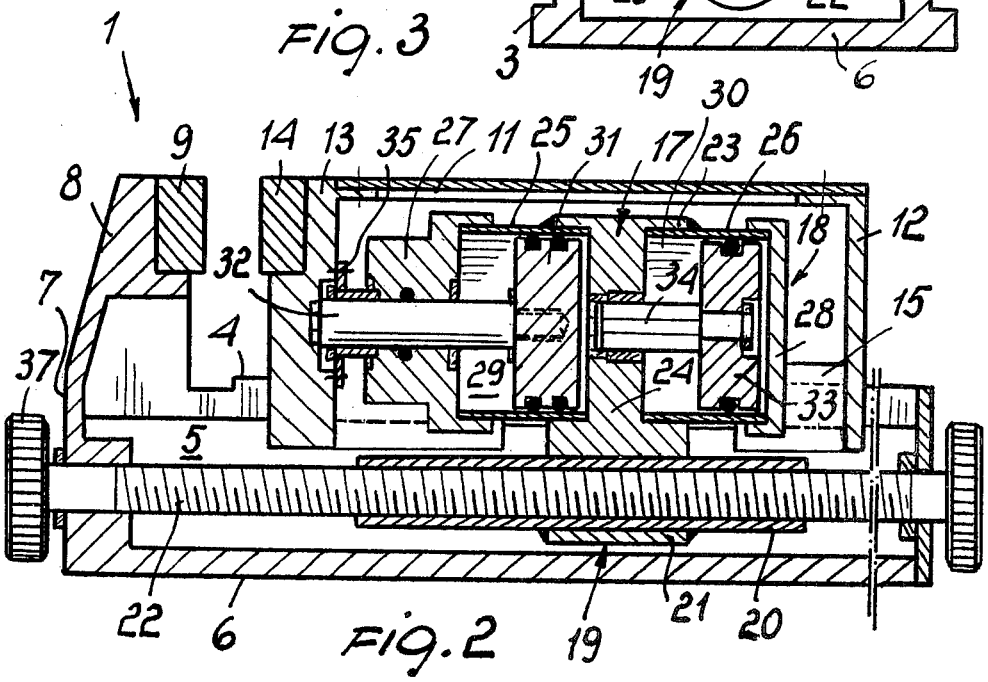
FIG. 2 is a longitudinal sectional elevation.

The drawings will now be examined with particular reference firstly to FIG. 1, but also bearing in mind the other figures for greater detail. A clamping device, thereinafter called "vice," particularly suitable for holding workpieces being machined on machine tools, such as milling machines, is indicated overall by the reference numeral 1. As in the case of a traditional manually operated vice, also the vice according to the invention consists of a robust body 2 in the form of a single block cradle to house the mobile parts of the device. The body comprises an elongated, hollow base 3 along nearly the entire length of which run two lateral guides 4 of T cross-section, with a web portion and a flange portion which form the upper surfaces of the two longitudinal walls 5. The base 3 consists of substantially rectangular plate with a lower support surface 6 which allows the vice to be placed on a work bench. Appropriate slots are provided in the base 3 for its fixing to a bench. The cradle formed by the body 2 is open at one end, and closed at the other end by a thick wall 7 which projects upwards by way of a wall portion 8 acting as a fixed jaw support, the actual jaw 9 consisting of an inlaid block. A carriage 10 or slide in the form of a heavy box frame slides on the guides 4, resting by its two longitudinal sides 11 on the respective guides 4. The rear wall, i.e. that farthest from the jaw, is formed by a short transverse side 12 of the frame 10, while the other short transverse side 13 forms the front wall and the support for the mobile jaw 14 analogous to the fixed inlaid jaw. The longitudinal sides 11 of the carriage continue towards the interior of the cradle by way of a non-symmetrical U section 15 which embraces the T section of the guides. This detail is visible in FIG. 3 to the left of the drawing, where it can be seen that this section, forming the guide gib of the slidable carriage, is made in a single piece with the carriage itself. The U section of the gib cannot be seen to the right of this figure as the section has been taken on a different vertical plane for each side, to show that the gib 15 is interrupted or recessed on both sides in the middle part of the carriage, while the wall 11 continues to rest by a L appendix on the guide 4, so leaving a portion of the guide resting surface free or exposed close to the inner corner of the guide. This gap in the middle region of the guide gibs 15 of the carriage 10 is provided in order to leave a support portion free on the guides 4 for the two lateral shoes 16 (only one of which is visible in the drawing) these shoes preferably comprising an upper support surface 16*a* and a lower support surface 16*b* which guide a cylindrical member 17 of a hydraulic cylinder or fluid operated actuator assembly indicated overall by 18, inserted into the carriage 10 and in operational engagement with the carriage in the manner to be described. The cylindrical member 17 forms the support framework for the hydraulic assembly and is rigid with nut screw means 19 formed from a threaded tube 20 on which a sleeve 21 forming a single piece with the cylindrical member 17 is keyed. The nut screw means 19 are slidable by screwing on a threaded bar 22 which is rotatably mounted but locked against axial movement, provided in the cradle of the body 2 in a longitudinal central plane close to the base and parallel to the guides 4. It therefore lies under the carriage in which the cylinder 18 is disposed, and coupled to the nut screw means 19 which project from below the carriage as an appendix to the cylinder, which therefore moves along the threaded bar. The thread of the threaded bar is adapted for rapid positioning, and for this reason a very long coupling is provided to distribute the load over a number of thread turns.

It will be understood that the screw means constituted of the internally threaded tube 20 and the externally threaded bar 22 form a jacklike actuator for prepositioning the movable jaw supporting frame.

According to the fundamental characteristic of the invention, the carriage 10 is not coupled to the threaded bar but only to the cylinder piston rod, the cylinder therefore not being supported by the carriage sliding on the guides, but being essentially supported by the threaded bar by way of the nut means, the cylinder shoes 16 which slide on the guides being mainly for keeping the cylinder centred and preventing its rotation when the bar 22 is rotated to move the nut screw forward.

Having now explained the respective linkages and relative mechanical couplings of the parts, the hydraulic operating member, namely the assembly comprising the cylinder 18, will now be described. The assembly used in the example is not binding for the invention, but the rational and practical arrangement and the coupling methods of the invention have facilitated the use of the chosen assembly, as will be more evident hereinafter.

The casing of the cylinder 17 is not a complete body in which the cylindrical compartments are formed, but instead offers for the dynamic system only an annular wall 23 projecting cup-like from the two faces of a disc 24 forming a central baffle or dividing wall therein. Two cylindrical walls 25 and 26, closed by covers 27 and 28 respectively, are inserted into the two formed cups. There are thus two cylindrical chambers 29 and 30 in which slide two pistons, 31 with its rod 32 and 33 with its rod 34. The rod 32 is engaged, with its end projecting from the cylinder, with the jaw support wall 13 of the carriage, by means of a system, for example a stop flange 35, which enables the carriage to be pushed or pulled. The described hydraulic assembly is of the two-piston double acting type comprising two independent fluids, either air-oil or oil-oil, with the piston 34 and the cylindrical chamber 30 being normally operated by an external pressure unit, and controlled by a two-way and shut-off valve 36.

The rod 34 of the piston 33 tightly traverses the dividing wall 24 and projects into the chamber 29 which is full of oil and operates as a hydraulic press. In this respect, when the rod 34 advances into the cylindrical chamber 29 it pressurises the oil, which transmits a force to the piston 31 increased by the ratio of the piston area to the rod area; the increased force acting on the piston 31 is transmitted by the rod 32 to the carriage 10, and particularly to the mobile jaw 14 thereby.

The operation of the entire device is apparent. By operating one of the knobs 37 rigid with the threaded bar 22, and situated at the two ends of the bar, one of which projects from the wall 7 and the other from an added end wall 38, or by operating a corresponding handle instead of these knobs, the nut screw is made to move on the bar, along the cradle. The nut screw carries rigid therewith the cylindrical member 17 and correspondingly the entire dynamic cylinder assembly 18. The carriage 10 is moved into the required gripping position by the rod 32, which is in the rest position as the force is minimum. When the bar rotation ceases, the nut screw with its cylinder remains automatically locked because of the irreversibility of the motion between the screw and nut screw. The valve 36 is then operated to feed pressurised fluid, either air or oil, from an external pressure unit (not shown) into the chamber 30 to the right of the piston 33, i.e. on the same side as the cover 28, to initiate the dynamic process heretofore explained. To disengage the vice, the delivery of the valve 36 is reversed, and the chamber 30 is put under pressure on the same side as the dividing wall 24: the piston 33 then withdraws, so sucking therewith the piston 31 with its rod 32, as there is no opposing force. The movement of the rod 32 may be made minimal, and of the order of 1–2 mm as desired. The fundamental characteristic which distinguishes the invention is therefore the elimination of the carriage existing in all previous vices of this type, which is driven by the nut screw and carries the cylinder rigid therewith. This essential simplification has been made possible by a careful analysis of the forces, and the discovery, which now seems banal because the new device makes it evident, that the reaction of the mobile jaw is completely discharged on to the threaded bar. The absorption of the moment by the previous carriage comprising U-shaped guide gibs, such as those of the carriage 10, can be and in fact is effectively compensated with advantage, because carriage slack is avoided, by the long nut screw tube 20 and the sleeve 21 which distribute the forces over a long portion of the bar and help it to resist by stiffening it, while the shoes 16 may be made much shorter because even a slight inclination of the cylinder does not influence the action of the vice. This fundamental characteristic directly or indirectly leads to all the advantages appearing from the description, and of which the main but not sole advantages of the invention may be summarised as follows:

a. considerable constructional simplicity is obtained;

b. the cradle has been shortened, for equal useful opening distances of the vice, by the elimination of one carriage;

c. although the jaw support carriage of the invention is shorter than the sum of the two carriages of previous compared vices, it is longer than the previous jaw support carriages, with all the advantages of stability and long life which this leads to;

d. the arrangement of the cylinder inside the jaw support carriage, made possible only by the invention, allows the thrust to be directly applied to the front jaw support wall instead of to the rear wall, so reducing carriage stresses, moments and deformation;

e. eliminating the cylinder support carriage has allowed the cylinder to be brought close to the threaded bar, so reducing the moment due to the thrust of the rod 32 relative to the bar;

f. by arranging the cylinder inside the jaw support carriage, a central portion of the guides is utilized without reducing the resisting moment of the carriage guide gibs, and at the same time a longer cylinder may be used without taking space from the carriage or increasing overall size, so making it easier to use a double cylinder with the effect of multiplying the force (hydraulic press);

g. the preferred but not binding use of the force multiplier enables large forces to be obtained with a small cylinder and a pressure unit of low pressure, so saving both installed power and consumption, as the same force may be applied by a lower pressure. This method is particularly favourable in a vice in which the movement under force is a minimum.

A further characteristic of the invention is that it may be subjected to many adaptations and modifications. It has already been stated that the two transmissions, namely the motion and force transmissions, may be of any type independently of each other. In the described preferred embodiment, the former is of the screw type and the latter is hydraulic. In a second preferred embodiment, the force transmission is also of screw type, by a threaded bar passing through the member 17 and engaged in a female thread in the member 17. Preferably this bar replaces the rod 34, because of which the chamber 30 would be dispensed with, with a rod extension thereof penetrating in a sealed manner into the hydraulic chamber 29 to carry out the thrust multiplication or hydraulic press function in cooperation with the piston 31.

In addition, all other transmission combinations and other equivalent modifications which use the clearly defined concept lie within the scope of the inventive idea.

I claim:

1. In a vice including a hollow base having a longitudinal extension, a fixed jaw rigid therewith and arranged near one end thereof, a movable box-like frame slidable along said base in the direction of said longitudinal extension, a movable jaw rigidly supported by said frame, a fluid operated actuator for said movable jaw and arranged in the interior of said box-like frame and movable therewith, a pre-positioning jack-like actuator for pre-positioning said fluid operated actuator and adapted to act in said direction of longitudinal extension of said base, the combination of said base with said fluid operated actuator, said jack-like actuator and said movable box-like frame, comprising spaced apart parallel guides on said base and coextensive with said longitudinal extension thereof, said guides having each a T-like cross-section with a web portion and a flange portion, spaced apart parallel gib formations on said box-like frame in slidable engagement with said guides over a substantial length thereof, said gib formations having a U-like cross-section surrounding at least partially said flange portion of the guides to provide a positive slidable engagement therewith, an elongated recess in an intermediate portion of at least one of said gib formations at an inwardly facing side thereof with respect to said box-like frame to expose thereto an intermediate longitudinal exposed portion of said flange formation in slidable engagement therewith, lateral shoes rigid with said fluid operated actuator and in slidable engagement with said exposed portion of said flange formation of said guide to guide said fluid operated actuator therealong and to prevent rotation thereof about an axis parallel to said longitudinal extension.

2. The combination of claim 1, wherein said jack-like actuator comprises a threaded bar coextensive with said longitudinal extension and journalled at both ends thereof on said hollow base and an internally threaded tube rigid with said fluid operated actuator screwingly engaging with said threaded bar and having a substantial extension in longitudinal direction thereof.

* * * * *